US007867381B2

(12) United States Patent
Koseoglu

(10) Patent No.: US 7,867,381 B2
(45) Date of Patent: Jan. 11, 2011

(54) PROCESS FOR REMOVAL OF NITROGEN AND POLY-NUCLEAR AROMATICS FROM FCC FEEDSTOCKS

(75) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 12/789,910

(22) Filed: May 28, 2010

(65) Prior Publication Data

US 2010/0252483 A1 Oct. 7, 2010

Related U.S. Application Data

(62) Division of application No. 11/593,968, filed on Nov. 6, 2006, now Pat. No. 7,763,163.

(51) Int. Cl.
*C10G 25/05* (2006.01)

(52) U.S. Cl. ..... 208/254 R; 208/91; 208/67; 208/113; 208/85; 208/310 R; 585/820

(58) Field of Classification Search ..... None
See application file for complete search history.

(56) References Cited

U.S. PATENT DOCUMENTS 3,227,645 A 1/1966 Frumkin et al.
3,252,894 A 5/1966 Gatsis et al.
3,767,563 A 10/1973 Woodle
4,239,616 A 12/1980 Gearhart
4,290,880 A 9/1981 Leonard
4,305,814 A 12/1981 Leonard
4,411,790 A 10/1983 Arod et al.
4,427,539 A 1/1984 Busch et al.
4,447,315 A 5/1984 Lamb et al.
4,502,944 A 3/1985 Nelson
4,572,781 A 2/1986 Krasuk et al.
4,618,412 A 10/1986 Hudson et al.
4,624,776 A 11/1986 Long et al.
4,634,516 A 1/1987 Haskell et al.
4,663,028 A 5/1987 Ditman
4,747,936 A 5/1988 Penning
4,775,460 A 10/1988 Reno
4,810,367 A 3/1989 Chombart et al.
4,816,140 A 3/1989 Trambouze et al.
4,885,080 A 12/1989 Brown et al.
4,954,242 A 9/1990 Gruia
4,997,544 A 3/1991 Chou et al.
5,124,023 A 6/1992 Bosserman et al.

(Continued)

OTHER PUBLICATIONS

International Search Report mailed on Apr. 23, 2008 by the ISA/US in application No. PCT/US2007/022381, pp. 1 and 2.

(Continued)

*Primary Examiner*—Tam M Nguyen
(74) *Attorney, Agent, or Firm*—Abelman, Frayne & Schwab

(57) ABSTRACT

A feedstream to an FCC unit is treated to remove or reduce the content of polynuclear aromatics and nitrogen-containing compounds by contacting the feedstream with an adsorbent compound selected from attapulgus clay, alumina, silica gel and activated carbon in a fixed bed or slurry column and separating the treated feedstream that is lower in the undesired compounds from the adsorbent material. The adsorbent can be mixed with a solvent for the undesired compounds and stripped for re-use.

9 Claims, 3 Drawing Sheets

U.S. PATENT DOCUMENTS

| | | | |
|---|---|---|---|
| 5,190,633 | A | 3/1993 | Fetzer et al. |
| 5,308,586 | A | 5/1994 | Fritsche et al. |
| 5,374,350 | A | 12/1994 | Heck et al. |
| 5,624,547 | A | 4/1997 | Sudhakar et al. |
| 6,217,746 | B1 | 4/2001 | Thakkar et al. |
| 6,551,501 | B1 | 4/2003 | Whitehurst et al. |
| 6,558,531 | B2 | 5/2003 | Steffens et al. |
| 6,783,662 | B2 | 8/2004 | Draemel et al. |
| 6,805,790 | B2 | 10/2004 | Gupta et al. |
| 7,114,566 | B2 | 10/2006 | Vinegar et al. |
| 2006/0175229 | A1 | 8/2006 | Montanari et al. |
| 2007/0267327 | A1 | 11/2007 | Boakye |

OTHER PUBLICATIONS

Written Opinion mailed on Apr. 23, 2008 by the ISA/US in application No. PCT/US2007/022381, pp. 1-4.

International Preliminary Report on Patentability completed Jan. 8, 2010 by the ISA/US in application No. PCT/US2007/022381, pp. 1-3.

PROCESS FOR REMOVAL OF NITROGEN AND POLY-NUCLEAR AROMATICS FROM FCC FEEDSTOCKS

CROSS REFERENCE TO RELATED APPLICATION

The present application is a divisional application under 35 USC §121 of U.S. application Ser. No. 11/593,968, now U.S. Pat. No. 7,763,163 entitled "Process for Removal of Nitrogen and Poly-Nuclear Aromatics from Hydrocracker and FCC Feedstocks" and filed on Nov. 6, 2006 which is presently pending and is incorporated by reference in its entirety in the present application.

FIELD OF THE INVENTION

The invention relates to the treatment of feedstocks to improve the efficiency of operation of hydrocracking or fluid catalytic cracking (FCC) units and the improvement of hydrocrackers and the effluent product streams of fluid catalytic cracking units.

BACKGROUND OF THE INVENTION

It is well known that the presence of nitrogen and polynuclear aromatics ("PNA') in heavy oil fraction feedstocks have a detrimental effect on the performance of the hydrocracking unit. For example, in the operation of one refinery where the hydrocracker was fed by a de-metalized or de-asphalted stream included a high level of impurities such as nitrogen-containing compounds and PNA coming from a solvent de-asphalting unit were found to be present at 5-10% of the volume of the feedstock stream. The smoke point of kerosene product from the hydrocracking unit was less than 20 and the cetane number of diesel product from the hydrocracking was about 65. This compares unfavorably to a kerosene smoke point of at least 25 and a diesel cetane number of at least 70 from a hydrocracker running on a straight run vacuum gas oil or standard feedstock.

As used herein, a "standard feedstock" means one that has a very low volume and weight percent of nitrogen-containing and PNA compounds as measured by Micro Carbon Residue (MCR) and $C_5$-asphalthenes. The MCR value is determined by ASTM Method Number D-4530. The $C_5$-Asphalthenes value is defined as the amount of asphaltenes precipitated by addition of n-pentane to the feedstock as outlined in the Institute of Petroleum Method IP-143. A standard feedstock preferably has not more than 1000 ppmw of nitrogen and less than 1 W % of MCR or less than 500 ppmw of $C_5$-Asphalthenes.

Various processes have been proposed for removal of compounds that reduce the efficiency of the hydrocracking unit and/or the quality of the products produced. For example, a two-stage process for the removal of polycyclic aromatics from hydrocarbon feedstreams in disclosed in U.S. Pat. No. 4,775,460. The first stage includes contacting the feedstream with a metal-free alumina to form polycyclic compounds or their precursors; this is followed by a second stage for removing the polycyclic compounds by contacting the feed with a bed of adsorbent, such as charcoal. These process steps are conducted at elevated temperatures, relatively low pressure, and preferably in the absence of hydrogen to avoid any hydrocracking of the heavy feedstream.

A process is disclosed in U.S. Pat. No. 5,190,633 for the separation and removal of stable polycyclic aromatic dimers from the effluent stream of the hydrocracking reactor that employs an adsorption zone, suitable adsorbents being identified as molecular sieves, silica gel, activated carbon, activated alumina, silica-alumina gel and clays. The adsorbent is preferably installed in a fixed-bed, in one or more vessels, and either in series or parallel flow; the spent zone of adsorbent can be regenerated. The heavy hydrocarbon oil passing through the adsorption zone is then recycled to the hydrocracking zone for further processing and conversion of lower boiling hydrocarbons.

In a refinery, the hydrocracking feedstock can be a blend of vacuum gas oil ("VGO") and de-metalized oil ("DMO") or De-Asphalted oil ("DAO") that is supplied by the n-paraffin de-asphalting units (where n-paraffin can include propane, butane, pentane, hexane or heptane) such as a DEMEX™ Process (a de-metallization process licensed by UOP). Processes for separating a resin phase from a solution containing a solvent, de-metallized oil and a resin are described in U.S. Pat. Nos. 5,098,994 and 5,145,574. A typical hydrocracking unit processes vacuum gas oils that contain from 10-25 V % of DMO or DAO in a VGO blend for optimum operation. It has been found that the DMO or DAO stream contains significantly more nitrogen compounds (2,000 ppmw vs. 1,000 ppmw) and a higher MCR content than the VGO stream (10 W % vs. <1 W %).

The DMO or DAO in the blended feedstock to the hydrocracking unit can have the effect of lowering the overall efficiency of the unit, i.e., by causing higher operating temperature or reactor/catalyst volume requirements for existing units or higher hydrogen partial pressure requirements or additional reactor/catalyst volume for the grass-roots units. These impurities can also reduce the quality of the desired intermediate hydrocarbon products in the hydrocracking effluent. When DMO or DAO are processed in a hydrocracker, further processing of hydrocracking reactor effluents may be required to meet the refinery fuel specifications, depending upon the refinery configuration. When the hydrocracking unit is operating in its desired mode, that is to say, producing products in good quality, its effluent can be utilized in blending and to produce gasoline, kerosene and diesel fuel to meet established fuel specifications.

It is therefore a principal object of the present invention to provide a process for improving the petroleum or other sources including shale oil, bitumen, tar sands, and coal oil feedstock to a hydrocracking unit or to a fluid catalytic cracking unit by removing high-nitrogen containing compounds and poly-nuclear aromatic hydrocarbons that deactivate active on the hydrocracker catalyst or fluid catalytic cracking catalysts.

It is another object of the invention to improve the quality of the feedstock derived from petroleum, shale oil, bitumen, tar sands and coal oils to a hydrocracking or fluid catalytic cracking unit in order to improve the overall efficiency of the hydrocracking or fluid catalytic cracking process, and the yields and quality of the products produced.

Another object of the invention is to increase the hydrocracking unit processing capacity for processing heavier feedstock materials such as DMO or DAO or VGO or heavy cycle oils from a fluid catalytic cracking unit (HCO), visbroken oil (VBO), coker gas oils (CGO) alone or in blends with vacuum gas oils without modifying the structure of the existing hydrocracking unit.

Yet another object of the invention is to provide a hydrocracking process improvement that will have a positive effect on catalyst activity and stability, to increase the useful life of the catalyst, and to thereby reduce operating costs.

It is yet another object of the invention to increase the fluid catalytic cracking conversion rate, i.e., to increase the yield of gasoline while minimizing the production of undesirable side products such as coke and total $C_1$-$C_2$ gas yields.

It is another object of the invention to decrease catalyst consumption in fluid catalytic cracking process unit operations by providing a feedstock which nitrogen containing compounds and poly-nuclear aromatic compounds have been removed.

It is another object of the invention to reduce the emissions of oxides of sulfur and nitrogen (SOX and NOX) in fluid catalytic cracking process unit operations.

SUMMARY OF THE INVENTION

The above objects and other advantages are achieved by the process of the present invention which comprises the steps of:

(a) providing a heavy hydrocracking feedstock, which may be from n-paraffin de-metalized or de-asphalted oil (where n-paraffin may be propane, butane, pentane, hexane or heptane) or coker gas oils or heavy cycle gas oils from fluid cracking operations, coker gas oils, visbroken gas oils containing high nitrogen and PNA molecules;

(b) passing the feedstock through at least one packed bed column containing adsorbent packing material such as attapulgus clay, alumina, silica, and activated carbon or mixing the feedstock with adsorbent material and passing them through a slurry column;

(c) absorbing the nitrogen and PNA molecules on the adsorbent packing material to provide a clean feedstock;

(d) maintaining the at least one packed column or slurry column at a pressure in the range of 1-30 $Kg/cm_2$ and a temperature in the range of 20-250° C.;

(e) continuously withdrawing the clean feedstock from at least one packed column or slurry column, and (f) passing the cleaned feedstock to the inlet of a hydrocracking unit or fluid catalytic cracking unit.

(g) fractionating the solvent from the solvent/rejected hydrocarbon stream in a solvent fractionation tower to recover the solvent for reuse in the process.

The process of the invention broadly comprehends treating the hydrocarbon feedstream upstream of the hydrocracking unit or the fluid catalytic cracking unit to remove the nitrogen-containing hydrocarbons and PNA compounds and passing the cleaned feedstock to the hydrocracking unit or fluid catalytic cracking unit. A second effluent feedstream comprising the nitrogen-containing and PNA compounds are preferably utilized in other refinery processes, such as fuel oil blending or processed in residue upgrading units such as coking, hydroprocessing or asphalt units.

The process of the invention is particularly advantageous in treating hydrocracking or fluid catalytic cracking unit feedstocks that comprise the effluents of de-metalizing or solvent de-asphalting units, coking units, visbreaking units, fluid catalytic cracking units, and vacuum distillation units. The DMO or DAO, vacuum gas oil (VGO) or heavy cycle oils (HCO), coker gas oils (CGO) or visbroken oils (VBO) can be processed alone or be blended with each other in any desired range from 0 to 100% by volume.

BRIEF DESCRIPTION OF THE DRAWINGS

The invention will be further described below and with reference to the attached drawings in which the same numbers are used to refer to the same or similar elements and where.

DETAILED DESCRIPTION OF THE PREFERRED EMBODIMENTS

Figure 1:
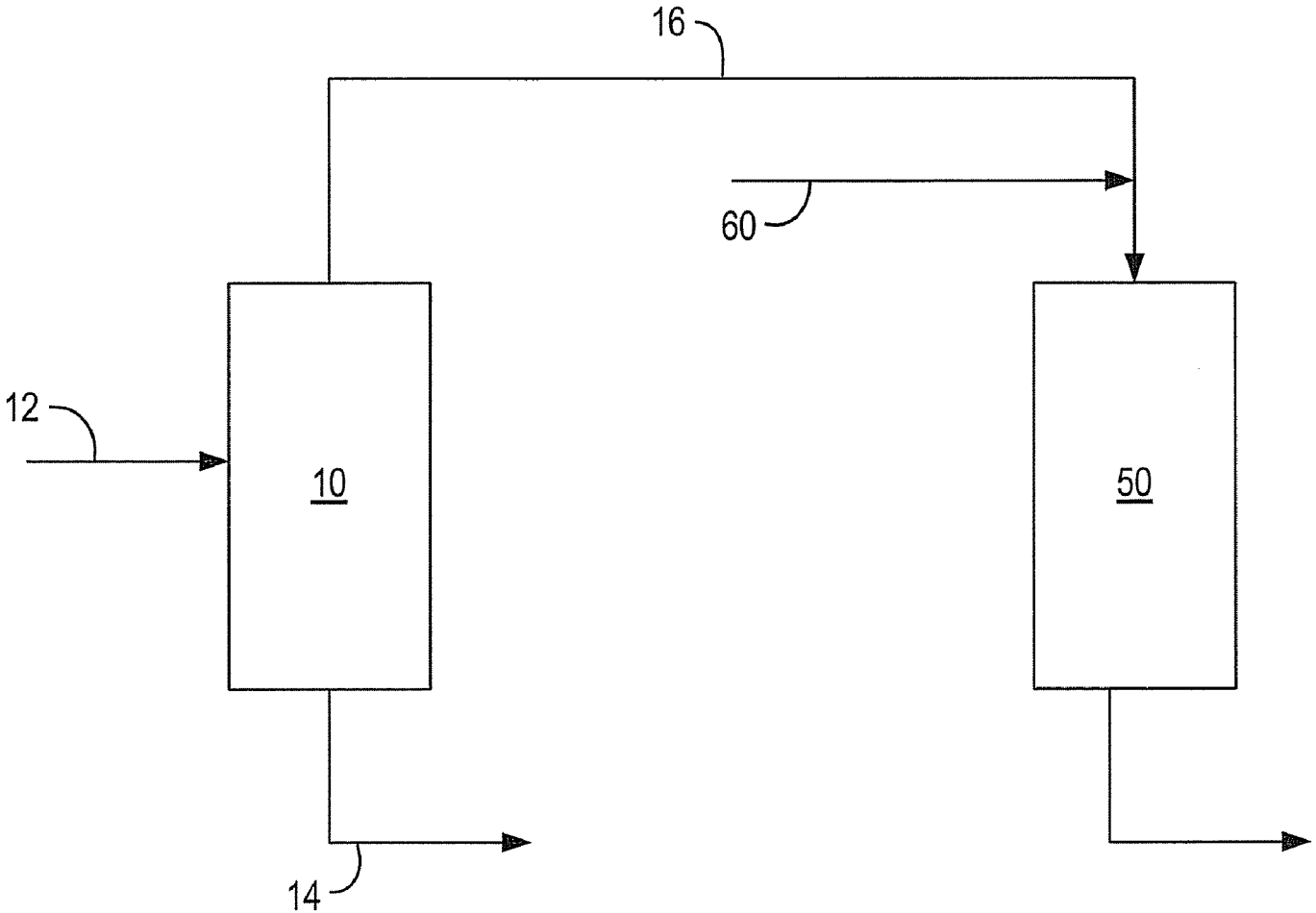
FIG. 1 PRIOR ART
FIG. 1 is a simplified schematic illustration of a typical process of the prior art.

With reference to the prior art process diagram of FIG. 1, a solvent demetalizing or de-asphalting unit 10 receives a feedstream of heavy product 12 as atmospheric or vacuum residues from a vacuum distillation of volatiles (not shown) for treatment. Asphaltenes 14 are removed as bottoms and the de-metalized oil (DMO) or deasphalted oil (DAO) stream 16 is removed for delivery as a feedstock to the hydrocracking unit 50. In the processes of the prior art, the DMO or DAO are blended with other streams 60, such as VGO, and passed directly to the hydrocracking unit or fluid catalytic cracking unit.

Figure 2:
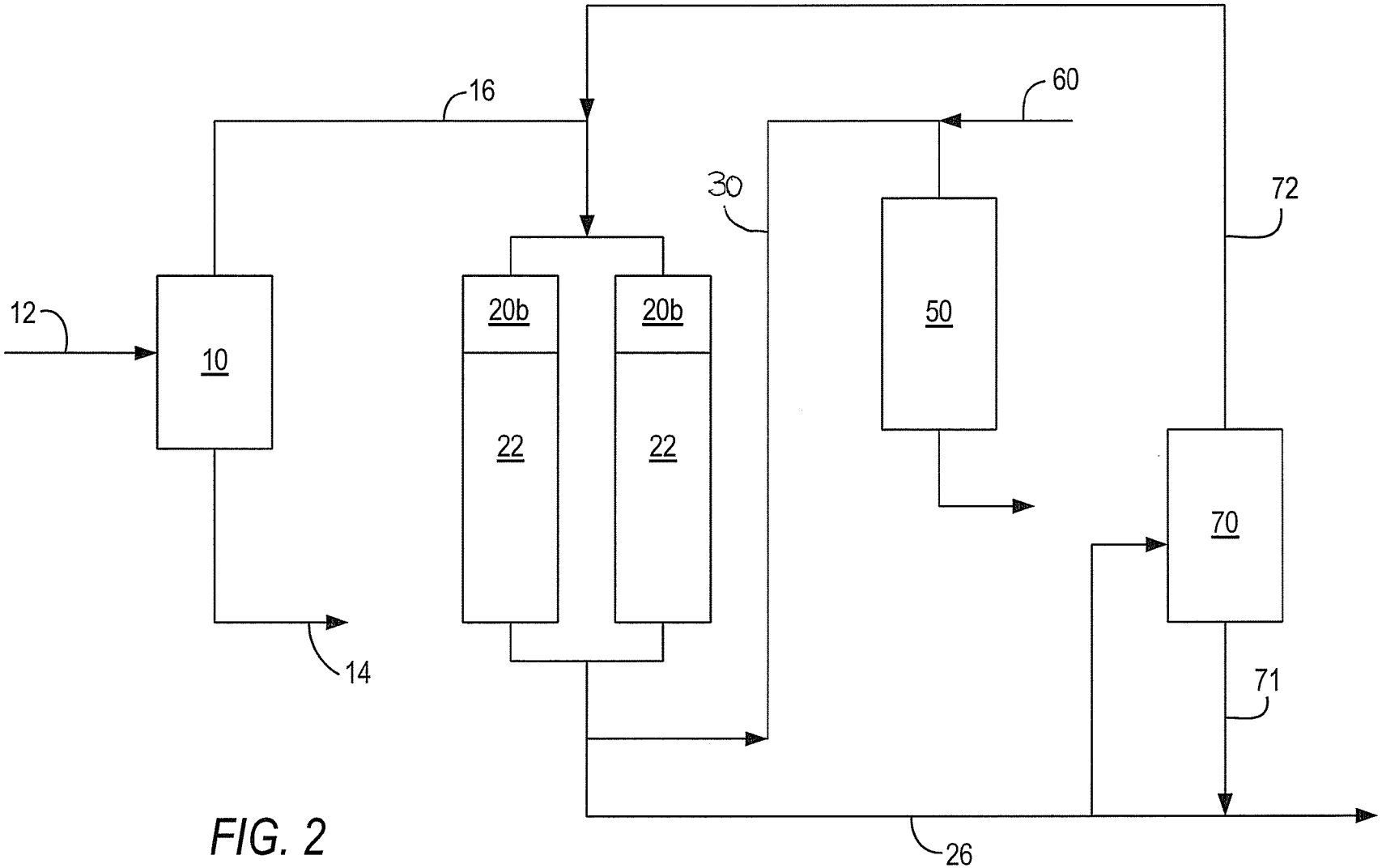
FIG. 2 is a schematic illustration of one preferred embodiment of the process of the present invention.

In accordance with the process of the invention as shown in FIG. 2, the DMO or DAO stream is fed to the top of at least one packed bed column 20*a*. It will be understood that the source of the heavy feedstock 16 can be from other refinery operations such as coking units, visbreaking units and fluid catalytic cracking units.

In a preferred embodiment, two packed bed columns, or towers 20*a*, and 20*b* are gravity fed or pressure force-fed sequentially in order to permit continuous operation when one bed is being regenerated. The columns 20 are preferably filled with an adsorbent material, such as attapulgus clay, alumina, silica or activated carbon. The packing can be in the form of pellets, spheres, extrudates or natural shapes.

In the operation of the process, the feedstream 16 enters the top of one of the columns, e.g., column 20*a*, and flows under the effect of gravity or by pressure over the packing material 22 where the high nitrogen-containing and PNA compounds are absorbed.

The packed columns 20*a*, 20*b* are preferably operated at a pressure in the range of from 1 to 30 $Kg/cm_2$ and a temperature in the range of from 20° to 205° C. These operating ranges will optimize retention of the high nitrogen and PNA compounds on the adsorbent material 22.

The cleaned feedstock 30 is removed from the bottom of column 20*a* and passed to the hydrocracking unit or fluid catalytic cracking unit 50. Optionally, the cleaned feedstream 30 can be blended with other feedstocks 60, such as a VGO stream, that is being processed in unit 50.

In a particularly preferred embodiment, the columns are operated in swing mode so that production of the cleaned feedstock is continuous. When the adsorbent packing in column 20*a* or 20*b* becomes saturated with adsorbed nitrogen and PNA compounds, the flow of feedstream 16 is directed to the other column. The adsorbed compounds are desorbed by heat or solvent treatment. The nitrogen and PNA containing adsorbed fraction can be desorbed by either applying heat with an inert nitrogen gas flow at the pressure of 1-10 $Kg/cm^2$ or by desorption with an available fresh or recycled solvent stream 72 or refinery stream, such as naphtha, diesel, toluene, acetone, methylene chloride, xylene, benzene or tetrahydrofuran in the temperature range of from 20° C. to 250° C.

In the case of heat desorption, the desorbed compounds are removed from the bottom of the column as stream 26 for use in other refinery processes, such as residue upgrading facilities, including hydroprocessing, coking, the asphalt plant, or is used directly in fuel oil blending.

Solvents are selected based on their Hildebrand solubility factors or by their two-dimensional solubility factors. The overall Hildebrand solubility parameter is a well-known measure of polarity and has been calculated for numerous compounds. See the *Journal of Paint Technology, Vol.* 39, No. 505 (February 1967). The solvents can also be described by their two-dimensional solubility parameter. See, for example, I. A. Wiehe, *Ind. & Eng. Res.,* 34 (1995), 661. the complexing solubility parameter and the field force solubility parameter. The complexing solubility parameter component, which describes the hydrogen bonding and electron donor-acceptor interactions, measures the interaction energy that requires a specific orientation between an atom of one molecule and a second atom of a different molecule. The field force solubility parameter, which describes the van der Waals and dipole interactions, measures the interaction energy of the liquid that is not destroyed by changes in the orientation of the molecules.

In accordance with this invention the non-polar solvent, or solvents, if more than one is employed, preferably have an overall Hildebrand solubility parameter of less than about 8.0 or the complexing solubility parameter of less than 0.5 and a field force parameter of less than 7.5. Suitable non-polar solvents include, e.g., saturated aliphatic hydrocarbons such as pentanes, hexanes, heptanes, parafinic naphthas, $C_5$-$C_{11}$, kerosene $C_{12}$-$C_{15}$, diesel $C_{16}$-$C_{20}$, normal and branched paraffins, mixtures or any of these solvents. The preferred solvents are $C_5$-$C_7$ paraffins and $C_5$-$C_{11}$ parafinic naphthas.

In accordance with this invention, the polar solvent(s) have an overall solubility parameter greater than about 8.5 or a complexing solubility parameter of greater than 1 and field force parameter of greater than 8. Examples of polar solvents meeting the desired minimum solubility parameter are toluene (8.91), benzene (9.15), xylenes (8.85), and tetrahydrofuran (9.52). The preferred polar solvents used in the examples that follow are toluene and tetrahydrofuran.

In case of solvent desorption, the solvent and rejected stream from the adsorbent tower is sent to a fractionation unit 70 within the battery limits. The recovered solvent stream 72 is recycled back to the adsorbent towers 22 for reuse. The bottoms stream 71 from fractionation unit 70 can be sent to other refinery processes, such as residue upgrading facilities, including hydroprocessing, coking, asphalt plant or is used directly in fuel oil blending.

Figure 3:
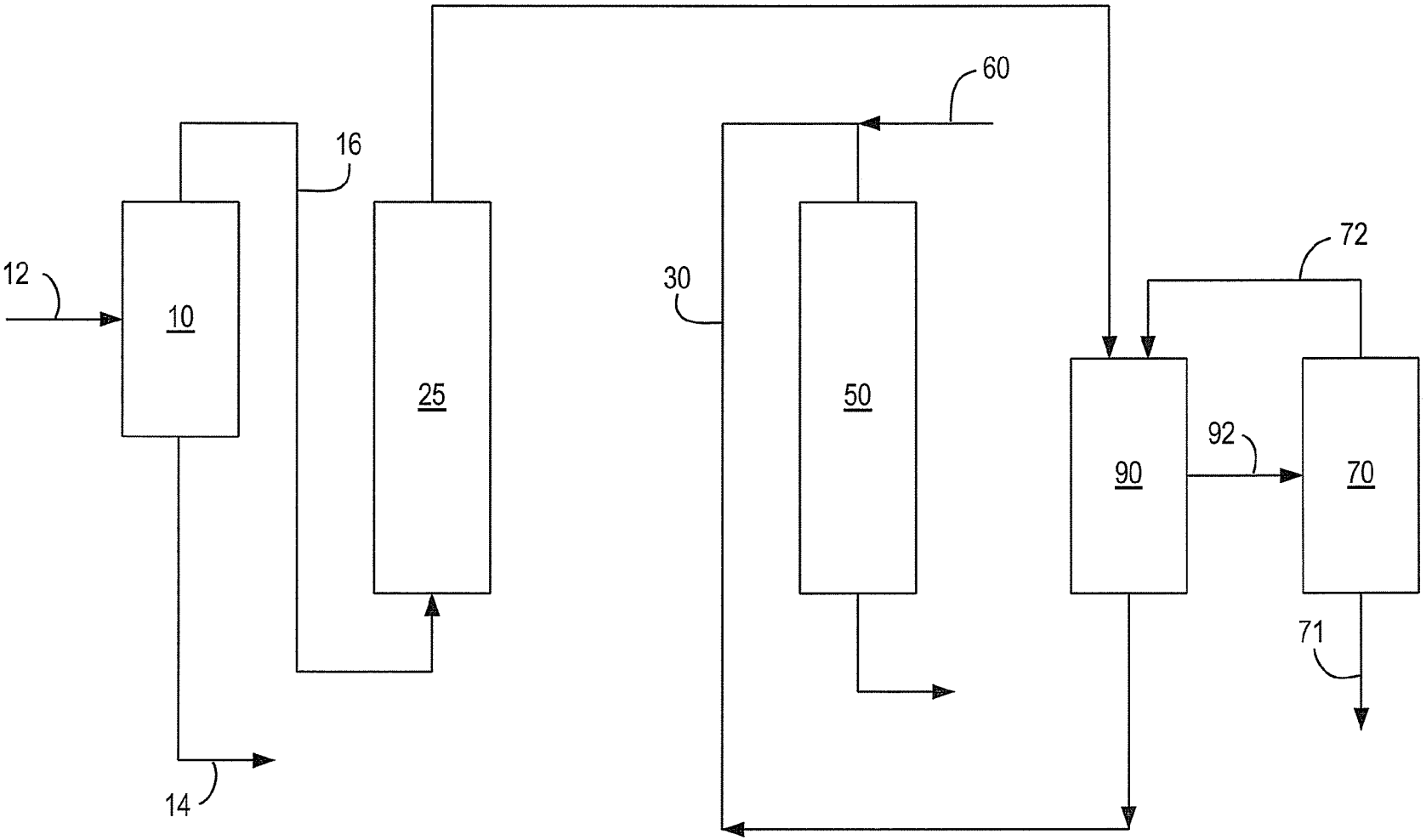
FIG. 3 is a schematic illustration of another preferred embodiment of the present invention.

In the case of a slurry bed as shown in FIG. 3, the feedstock and adsorbents are fed to the slurry column 22 from the bottom by a pump and then delivered to filtering apparatus 90 to separate the solid adsorbent from the treated liquid stream (30). The liquid stream (30) is then sent to the hydrocracking or fluid catalytic cracking unit 50. The solid adsorbent is washed by solvents or refinery streams such as naphtha, diesel, toluene, acetone, methylene chloride, xylene, benzene or tetrahydrofuran in the temperature range of from 20° C. to 205° C. The solvent mixture (92) is fractionated in the fractionation unit 70 and recycled back to the filtering apparatus (90) for reuse.

The extracted hydrocarbon stream (71) from the fractionation unit (70) is then sent to other refinery processes such as residue upgrading facilities including hydroprocessing, coking, asphalt plant or used directly in fuel oil blending.

Example 1

De-Metalized Oil Pretreatment

Attapulgus clay with 108 $m^2/g$ surface area and 0.392 $cm^3/g$ pore volume was used as an adsorbent to remove nitrogen and PNA in a de-metallized oil stream. The virgin DMO contained 85.23 W % carbon, 11.79 W % hydrogen, 2.9 W % sulfur and 2150 ppmw nitrogen, 7.32 W % MCR, 6.7 W % tetra plus aromatics as measured by a UV method. The mid-boiling point of the DMO stream was 614° C. as measured by ASTM D-2887 method. The de-metallized oil is mixed with a straight run naphtha stream boiling in the range 36-180° C. containing 97 W % paraffins, the remainder being aromatics and naphthenes at 1:10 V:V % ratio and passed to the adsorption column containing Attapulgus clay at 20° C. The contact time for the mixture was 30 minutes. The naphtha fraction was distilled off and 94.7 W % of treated DMO was collected. The process reject 1 and 2 fractions yields, which were stripped-off from the adsorbent by toluene and tetrahydrofuran, respectively, were 3.6 and 2.3 W %. After the treatment process, 75 W % of organic nitrogen, 44 W % of MCR, 12 W % of sulfur and 39 W % of tetra plus aromatics were removed from the DMO sample. No change was observed in the boiling point characteristics of the DMO sample as determined by ASTM D2887 and reported in the following table.

TABLE 1

| ° C. | IBP | 5 V % | 10 V % | 30 V % | 50 V % | 70 V % | 80 V % | 85 V % |
|---|---|---|---|---|---|---|---|---|
| DMO | 355 | 473 | 506 | 571 | 614 | 651 | 673 | 690 |
| Treated DMO | 360 | 472 | 505 | 569 | 611 | 648 | 671 | 691 |

The rejection of heavy poly nuclear aromatic compounds, which are hydrogen deficient and sulfur nitrogen rich, increased the hydrogen content of the treated DMO by 0.5 W %. The aromatic contents of DMO stream was measured by UV spectroscopy and summarized below as Tetra+, Penta+, Hexa+Hepta+aromatics in terms of mmol/100 g of DMO sample. Tetra plus aromatics contains aromatic molecules with ring number equal to, and greater than 4. Penta+aromatics contain aromatic molecules with ring number equal and higher than 5 and so on. The amount of aromatic removal increased with increasing ring size of the aromatic molecules, indicating that the process is more selective in removing large molecules.

TABLE 2

| Aromatics Type | | DMO | Treated DMO | Removal % |
|---|---|---|---|---|
| Tetra + aromatics | mmol/100 g | 29.35 | 18.50 | 37 |
| Penta + aromatics | mmol/100 g | 10.93 | 5.55 | 49 |
| Hexa + aromatics | mmol/100 g | 4.87 | 2.09 | 57 |
| Hepta + aromatics | mmol/100 g | 2.50 | 0.90 | 64 |

The following Table summarizes the yields and elemental analysis of the treated DMO and reject streams.

TABLE 3

| | Yields W % | Carbon W % | Hydrogen W % | Sulfur W % | Nitrogen ppmw |
|---|---|---|---|---|---|
| DMO | 100.0 | 85.22 | 11.23 | 3.31 | 2150 |
| Treated DMO | 94.7 | 85.23 | 11.79 | 2.90 | 530 |
| Reject 1 | 3.6 | 84.90 | 9.42 | 5.22 | 24600 |
| Reject 2 | 2.2 | 84.95 | 9.66 | 4.31 | 42300 |

Example 2

Vacuum Gas Oil Pretreatment

Attapulgus clay the properties of which are given in example 1 was also used as an adsorbent to remove nitrogen and PNA in a vacuum gas oil. The vacuum gas oil contained 85.40 W % carbon, 12.38 W % hydrogen, 2.03 W % sulfur and 1250 ppmw nitrogen, 0.33 W % MCR, 3.5 W % tetra plus aromatics as measured by UV method. The vacuum gas oil is mixed with straight run naphtha stream boiling in the range 36-180° C. containing 97 W % paraffins the remainder being aromatics and naphthenes at 1:5 V:V % ratio and passed to the adsorption column containing Attapulgus clay at 20° C. The contact time for the mixture was 30 minutes. The naphtha fraction was distilled off and 97.0 W % of treated VGO was collected. The process reject 1 and 2 fractions yields, which were stripped-off from the adsorbent by toluene and tetrahydrofuran, were 1.6 and 1.4 W % respectively. After the treatment process, 72 W % of organic nitrogen, 2 W % of sulfur, 10.9 W % of tetra plus aromatics and 50.4 W % hepta plus aromatics were removed form the VGO sample. No change was observed in the boiling point characteristics following treatment of the VGO stream.

TABLE 4

| | IBP | 5 V % | 10 V % | 30 V % | 50 V % | 70 V % | 90 V % | 95 V % | 100 V % |
|---|---|---|---|---|---|---|---|---|---|
| VGO | 321 | 359 | 381 | 440 | 483 | 522 | 571 | 591 | 656 |
| Treated VGO | 330 | 365 | 385 | 441 | 481 | 520 | 569 | 588 | 659 |

The aromatic removal increased with increasing ring size of the aromatic molecules, indicating that the process is selective in removing large molecules.

TABLE 5

| Aromatics Type | | VGO | Treated VGO | Removal % |
|---|---|---|---|---|
| Tetra + aromatics | mmol/100 g | 14.19 | 12.64 | 10.90 |
| Penta + aromatics | mmol/100 g | 3.56 | 2.72 | 23.64 |
| Hexa + aromatics | mmol/100 g | 1.18 | 0.81 | 31.17 |
| Hepta + aromatics | mmol/100 g | 0.46 | 0.23 | 50.38 |

The rejection of heavy polynuclear aromatic compounds, which are hydrogen deficient and sulfur and nitrogen rich, increased the hydrogen content of the treated VGO by 0.06 W %. The VGO aromatic data are given in the Table below which summarizes the material and elemental balances for the process.

TABLE 6

| | Carbon, W % | Hydrogen, W % | Sulfur, W % | Nitrogen, ppmw |
|---|---|---|---|---|
| VGO | 85.51 | 12.20 | 2.03 | 1250 |
| Treated VGO | 85.49 | 12.26 | 2.00 | 351 |
| Reject 1 | 86.58 | 8.03 | 3.58 | 17500 |
| Reject 2 | 84.64 | 9.45 | 3.72 | 21000 |

Example 3

Heavy Diesel Oil Treatment

Heavy diesel oil containing 85.2 W % of carbon, 12.69 W % hydrogen, 1.62 W % of sulfur and 182 ppmw of nitrogen was subjected to the treatment process of the invention using an adsorption column at 20° C. at LHSV of 2 $h^{-1}$. The pretreated heavy gas oil yield was 98.6 W %. The yield for the process reject fractions 1 and 2, which were stripped off by toluene and tetrahydrofuran, respectively, at a solvent-to-oil ratio of 4:1 V %, were 1.0 W % and 0.4 W %. The ASTM D2887 distillation curves for the heavy gas oil, treated heavy gas oil, reject 1 fraction which was desorbed from the adsorbent by toluene, and reject 2 fraction which is desorbed from the adsorbent by tetrahydrofuran, are shown in the Table below. The treatment process did not change the distillation characteristics of the heavy gas oil. The reject 1 and 2 fractions are heavy in nature with FBP 302 and 211° C. higher than that of the feedstock heavy gas oil. The process removes the heavy tails of the diesel oil fraction, which is not noticeable when the heavy gas oil is analyzed. The heavy fractions derived from the heavy gas oil are carried over during the distillation and can not be detected when the sample is analyzed by ASTM D2887 distillation due to its small quantity.

TABLE 7

| Streams | IBP | 5 V % | 10 V % | 30 V % | 50 V % | 70 V % | 90 V % | 95 V % | FBP |
|---|---|---|---|---|---|---|---|---|---|
| Heavy Gas Oil | 84 | 210 | 253 | 322 | 360 | 394 | 440 | 460 | 501 |
| Treated Heavy Gas Oil | 36 | 215 | 254 | 320 | 359 | 394 | 441 | 461 | 501 |
| Process Reject 1 | 267 | 322 | 342 | 385 | 420 | 451 | 497 | 535 | 803 |
| Process Reject 2 | 285 | 334 | 354 | 397 | 427 | 455 | 494 | 514 | 613 |

The diesel oil fractions were further characterized by two-dimensional gas chromatography. The gas chromatograph used in the sulfur speciation was a Hewlett-Packard 6890 Series GC (Hewlett-Packard, Waldbron, Germany), equipped with an FID and a SCD equipped with a ceramic (flameless) burner, being a Sievers Model 350 sulfur chemiluminescence detector (Sievers, Boulder, Colo., USA). This method determined the sulfur class compounds based on carbon number. To simplify the results, the sulfur compounds were combined as sulfides (S), thiols (Th), di-sulfides (DS), thiophenes (T), benzo-thiophenes (BT), naphtha-benzo-thiophenes (NBT), di-benzo-thiophenes (DiBT), naphtha-di-benzo-thiophenes (NDiBT), benzo-naphtha-thiophenes (BNT), naphtha-benzo-naphtha-thiophenes (NBNT), di-naphtha-thiophenes and the sulfur compounds that are unidentified (unknowns). The total sulfur content of the heavy gas oil is 1.8 W %. The majority of the sulfur compounds in the heavy gas oils were benzo-thiophenes (41.7 W % of total sulfur) and di-benzo-thiophenese (35.0 W % of total sulfur). Naphtha derivatives of the benzo- or dibenzothiophenes, which are the sum of NBT, NDiBT, BNT, NBNT and DiNT, are 16.7 W % of the total sulfur present. The process removed only 0.05 W % sulfur from the heavy gas oil. Although the sulfur removal was negligible, the rejected fractions contained a high concentration of sulfur compounds as shown in the following Table. The treated heavy gas oil contains less naphtha derivates, which are aromatic in nature. The majority of the sulfur present in the reject 1 and 2 fractions are naphtha derivatives of sulfur.

TABLE 8

| # | Sulfur Type | | HDO | Treated HDO | Reject 1 | Reject 2 |
|---|---|---|---|---|---|---|
| | Total Sulfur | W % | 1.82 | 1.77 | 4.8 | 4.41 |
| 1 | S, Th, DS | W % of S | 4.5 | 3.0 | 1.1 | 10.1 |
| 2 | T | W % of S | 2.1 | 2.0 | 0.9 | 4.9 |
| 3 | BT | W % of S | 41.7 | 45.0 | 10.9 | 14.6 |
| 4 | NBT | W % of S | 4.9 | 4.1 | 3.8 | 16.2 |
| 5 | DiBT | W % of S | 35.0 | 36.1 | 38.1 | 28.3 |
| 6 | NDiBT | W % of S | 4.8 | 3.4 | 9.5 | 10.6 |
| 7 | BNT | W % of S | 6.0 | 5.5 | 25.9 | 11.2 |
| 8 | NBNT | W % of S | 0.7 | 0.7 | 5.4 | 2.7 |
| 9 | DiNT | W % of S | 0.3 | 0.2 | 4.4 | 0.9 |
| 10 | Unknowns | W % of S | 0.1 | 0.1 | 0.1 | 0.6 |
| | Naphthos (4 + 6 + 7 + 8 + 9) | | 16.6 | 13.8 | 48.9 | 41.6 |

The heavy gas oil contained 223 ppmw of nitrogen, 75% of which was removed in the treatment process. The reject 1 and 2 fractions contained high concentrations of nitrogen compounds (11,200 and 14,900 ppmw respectively).

Nitrogen species were also analyzed by gas chromatography speciation techniques. Nitrogen speciation analyses were carried-out using an HP 6890 chromatograph (Agilent Technologies) with a Nitrogen Chemiluminescence Detector (NCD). The GC-NCD was performed using a non-polar column (DB1, 30 m 0.32 mm ID 0.3 μm film thickness) from J&W scientific, CA., USA.

The amount of indoles plus quinoleines and carbazole in the heavy gas oil were 2 and 1 ppmw, respectively, and were completely removed by the treatment. The majority of the nitrogen present in the heavy gas oil was as carbazole compounds with 3 or more alkyl rings. The treatment process removed 71.5 W % of the C3-carbazoles present. C1 and C2 carbazoles were present at low concentrations and removed at a rate of 92.1 and 86. %, respectively. In contrast to sulfur, the process was selective in removing nitrogen compounds.

TABLE 9

| Total nitrogen (ppmw) | HGO ppmw | Treated HGO ppmw | Removal % |
|---|---|---|---|
| Total Nitrogen | 223 | 60 | 73.1 |
| Indoles + Quinoleines | 2.0 | 0.0 | |
| Carbazole | 1.0 | 0.0 | 100.0 |
| C1 Carbazoles | 3.8 | 0.3 | 92.1 |
| C2 Carbazoles | 13.3 | 1.8 | 86.5 |
| C3+ Carbazoles | 202.9 | 57.9 | 71.5 |

A slight change was observed in the aromatic concentration of the treated heavy gas oil compared to the untreated one. The reject fractions shows high concentrations of aromaticity as compared to the feedstocks, indicating that heavy poly nuclear aromatics were removed from the feedstock during the treatment.

TABLE 10

| UV Aromatics | | HGO | Treated HGO | Reject 1 | Reject 2 |
|---|---|---|---|---|---|
| Mono | W % | 5.5 | 5.4 | 13.2 | 11.3 |
| Di | W % | 3.8 | 3.8 | 5.4 | 3.7 |
| Tri | W % | 2.9 | 2.7 | 14.9 | 6.0 |
| Tetra+ | W % | 1.5 | 1.2 | 16.2 | 9.5 |
| Total | | 13.7 | 13.1 | 49.7 | 30.5 |

Example 4

Heavy Oil Treatment in a Slurry Column

A heavy oil containing 84.63 W % carbon, 11.96 W % of hydrogen, 3.27 W % of sulfur and 2500 ppmw of nitrogen was contacted with attapulgus clay in a vessel simulating a slurry column at 40° C. for 30 minutes. The slurry mixture was then filtered and the solid mixture was washed with a straight run naphtha stream boiling in the range 36-180° C. containing 97 W % paraffins, the remainder being aromatics and naphtenes at 1:5 V:V % oil-to-solvent ratio. After fractionation of the naphtha stream, 90.5 W % of the product was collected. The slurry-adsorbent treated product contained 12.19 W % hydrogen (1.9% increase), 3.00 W % sulfur (8 W % decrease) and 1445 ppmw nitrogen (42 W % decrease). The adsorbent was further washed with toluene and tetrahydrofuran at 1:5 V:V % oil to solvent ratio and 7.2 and 2.3 W % of reject fractions were obtained, respectively. The reject fractions analyses were as follows:

TABLE 11

| Fraction | Carbon, W % | Hydrogen, W % | Sulfur, W % | Nitrogen, W % |
|---|---|---|---|---|
| Reject 1 | 84.11 | 10.32 | 5.05% | 0.55% |
| Reject 2 | 84.61 | 9.17 | 5.05% | 1.08% |

Quality Improvement

The feedstream and separated fractions were tested for total organic nitrogen, sulfur and aromatic content, where the aromatic content was determined as mono-, di-, tri-, and tetra-plus aromatics. Mono-aromatic compounds contain a single ring, while di-, tri- and tetra-aromatics contain two, three and four rings, respectively. The aromatic compounds with more than four aromatic rings are combined into one fraction referred to as tetra-plus aromatics for the purpose of this description. The adsorptive pretreatment process reduced the tetra-plus aromatic content by 1-2 percent by weight. The extracted fractions contained higher concentrations of the polyaromatic compounds. Specifically, it contained four (4) times the tetra-plus aromatics in the cleaned fraction. The fractions also contained a higher concentration of total organic nitrogen than the virgin demetallized oil. The virgin demetallized oil contained 2,000 ppmw of total organic nitrogen and the extracted fraction contained 4,000-10,500 ppmw of total organic nitrogen. The nitrogen removal from the demetallized oil was in the range 50-80 weight percent.

The treatment process also improved the quality of oil in terms of total organic sulfur, which is reduced by 20-50 weight percent. The hydrogen content of the demetallized oil also improved by at least 0.50 weight percent by the aromatic compounds.

The type of solvent/adsorbent used in the process affects the nitrogen removal rate. Therefore 50-80% range is shown for the nitrogen removal rate. The difference in removal rate is a function of solvent polarity, adsorbent structure, such as pore volume, acidity and available sites.

Process Improvement

The virgin demetallized oil and treated demetallized oil were hydrocracked in a hydrocracking pilot plant to determine the effect of the feedstock treatment process of the invention in hydrocracking operations with two types of commercial hydrocracking catalysts simulating the commercial hydrocracking unit in operation. The first catalyst was a first stage commercial hydrotreating catalyst designed to hydrodenitrogenize, hydrodesulfurize and crack fractions boiling above 370° C. The hydrocracking process simulated was a series-flow configuration in which the products from the first catalyst were sent directly to the second catalyst without any separations.

The effect of the feedstream treatment was determined by the conversion of hydrocarbons boiling above 370° C. The conversion rate is defined as one minus the converted hydrocarbons boiling above 370° C. divided by the hydrocarbons boiling above 370° C. in the feedstream. The conversion of hydrocarbons boiling above 370° C., operating hydrocracker temperature, and liquid hourly space velocity were used to calculate the required operating temperature for achieving 80 W % conversion of fractions boiling above 370° C. using the Arrhenius relationship.

The treated demetallized oil resulted in at least 10° C. more reactivity than the virgin demetallized oil, thereby indicating the effectiveness of the feedstock treatment process of the invention. The reactivity, which can be translated into longer cycle length for the catalyst, can result in at least one year of cycle length for the hydrocracking operations, or the processing more feedstock, or the processing of heavier feedstreams by increasing the demetallized oil content of the total hydrocracker feedstream.

The treated feedstream also yielded better quality products. For example, the smoke points of kerosene were 22 and 25, respectively, with the virgin and treated demetallized oils treated in accordance with the invention. The improvement may also be equated to a reduction of from 20% to 35% in the volume of catalyst required in newly designed unit. As will be apparent to those of ordinary skill in the art, this represents a substantial cost savings in terms of capital and operating costs.

The heavy diesel oil derived from Arabian light crude oils with ASTM D86 distillation 5V % points of 210 and 95 V % point of 460 was pretreated using Attapulgus clay at 20° C. and LHSV of 2 $h^{-1}$ and hydrotreated over a commercial catalyst containing Co and Mo on an alumina based support. The effect of pretreatment was measured by monitoring the sulfur removal rate and the required operating temperature by achieving the 500 ppmw sulfur in the product stream. The pretreated heavy gas oil required 11° C. lower operating temperature compared to the untreated heavy gas oil. This translates to 30% lower catalyst volume requirement in the hydrotreater to achieve the same level of sulfur removal.

Tests were conducted to determine the reactivity of the feedstream in fluid catalytic cracking operations over an equilibrated commercial catalyst. Two types of feedstocks were used. In the first test, straight run vacuum gas oil was used. The pretreated or cleaned vacuum gas oil resulted in at least an 8 W % increase in conversion. At the same conversion level, the pretreated feedstream resulted at least 2 W % more gasoline and 1.5 W % less coke, while dry gas ($C_1$-$C_2$), light cycle and heavy cycle oils yields remained at the same conversion levels.

In the second example, demetallized oil was used. Compared to the virgin oil, the pretreated demetallized oil produced 2-12 W % more conversion. Total gas (hydrogen, $C_1$-$C_2$) produced was 1 W % less with the pretreated demetallized oil at a 70 W % conversion level. The gasoline yield was 5 W % higher with the pretreated demetallized oil, while the light cycle oil (LCO) and heavy cycle oil (HCO) yields remained the same. The coke produced was 3 W % less with the pretreated demetallized oil. The research octane number was 1.5 point higher at the 70 W % conversion levels for the gasoline produced from the treated demetallized oil.

The process of the invention and its advantages have been described in detail and illustrated by various examples. However, as will be apparent from this description to one of ordinary skill in the art, further modifications can be made and the full scope of this invention is to be determined by the claims that follow.

I claim:

1. An improved hydrocracking process comprising a process for treating a feedstream to a fluid catalytic cracking (FCC) unit that includes nitrogen-containing compounds and PNA compounds, the feedstream selected from the group consisting of de-metalized oil, deasphalted oil, coker gas oils, visbroken gas oils, fluid catalytic cracking heavy oils and mixtures thereof, the process comprising the steps of:

(a) introducing the feedstream into the inlet port of at least one adsorption column that is upstream of an FCC unit, the feedstream containing an adsorbent material selected from the group consisting of attapulgus clay, alumina, silica gel and activated carbon;

(b) maintaining the feedstream in contact with the adsorbent material to adsorb the nitrogen-containing and PNA on the adsorbent material, while maintaining the at least one adsorption column at a pressure in the range of 1 $Kg/cm^2$ to 30 $Kg/cm^2$ and a temperature in the range of 20° C. to 250° C.;

(c) continuously withdrawing treated feedstream from the at least one adsorption column;

(d) directing the treated feedstream to an inlet of the FCC unit;

(e) desorbing the adsorbed nitrogen-containing and PNA compounds to regenerate the adsorbent material; and (f) reusing the regenerated adsorbent material in steps (a)-(e), above.

2. The process of claim 1, wherein the adsorbent material is packed into the at least one fixed bed adsorption column and is in the form of pellets, spheres, extrudates or natural shapes and in the size is has a range of 4-60 mesh.

3. The process of claim 2 which further comprises;

(a) passing the feedstream through a first of two packed adsorption columns;

(b) transferring the feedstream from the first adsorption column to the second adsorption column while discontinuing passage through the first column;

(c) desorbing and removing the nitrogen-containing and PNA compounds from the adsorbent material in the first adsorption column to thereby regenerate the adsorbent material;

(d) transferring the feedstock from the second adsorption column to the first adsorption column while discontinuing the flow of feedstock through the second adsorption column;

(e) desorbing and removing the nitrogen-containing and PNA compounds from the adsorbent material in the second adsorption column to thereby regenerate the adsorbent material; and (f) repeating steps (a)-(d), whereby the processing of the feedstream is continuous.

4. The process of claim 1 which comprises:

(a) mixing the feedstream with adsorbent material to form a slurry;

(b) passing the feedstream through the at least one adsorption column;

(c) passing the mixture to a filtration apparatus and filtering the treated feedstream to separate it from the adsorbent material;

(d) treating the filtrate with a solvent in the filtration apparatus to desorb and remove the nitrogen-containing and PNA compounds from the adsorbent material thereby regenerate the adsorbent material; and (e) delivering the solvent stream mixture to a fractionator to recover the solvent and the fraction of nitrogen-containing and polyaromatic compounds.

5. A fluid catalytic cracking process comprising:

(a) passing a feedstream containing hydrocarbons having boiling points above 370° C. through a first treatment zone that is upstream of an FCC reaction zone and maintained at a temperature in the range of from about 20° C. to 250° C. and a pressure in the range of from 1 $Kg/cm^2$ to 30 $Kg/cm^2$;

(b) contacting the feedstream with an adsorbent material in the first treatment zone;

(c) adsorbing nitrogen-containing and PNA compounds on the adsorbent material in the first treatment zone;

(d) withdrawing a treated hydrocarbon feedstream effluent from the first treatment zone; and (e) passing the treated hydrocarbon feedstock effluent into a fluid catalytic cracking zone that is maintained at cracking pressure and temperature conditions.

6. The process of claim 5, wherein the first treatment zone is a packed bed column or slurry column.

7. The process of claim 6, wherein the adsorbent material is selected from the group consisting of attapulgus clay, alumina, silica gel and activated carbon.

8. The process of claim 7, wherein the feedstream to the column is DMO or DAO drawn from the effluent of a demetalizing or de-asphalting unit or CGO or HCO or VBO from coking units, fluid catalytic cracking units or visbreaking units, respectively.

9. The process of claim 8, wherein about 85 to 90 volume percent of the DMO or DAO or CGO or HCO or VBO feedstream passed to the adsorption column is passed to the fluid catalytic cracking unit as treated feedstream.

* * * * *